US010018446B2

(12) United States Patent
Derousse

(10) Patent No.: US 10,018,446 B2
(45) Date of Patent: Jul. 10, 2018

(54) VERTICAL FORWARD GRIP

(71) Applicant: Damon William Derousse, Red Bud, IL (US)

(72) Inventor: Damon William Derousse, Red Bud, IL (US)

( * ) Notice: Subject to any disclaimer, the term of this patent is extended or adjusted under 35 U.S.C. 154(b) by 0 days.

(21) Appl. No.: 15/331,000

(22) Filed: Nov. 17, 2016

(65) Prior Publication Data

US 2017/0176136 A1 Jun. 22, 2017

(51) Int. Cl.

| | |
|---|---|
| ***F41C 23/16*** | (2006.01) |
| ***F41C 23/14*** | (2006.01) |
| ***F41C 23/12*** | (2006.01) |
| ***F41C 23/22*** | (2006.01) |

(52) U.S. Cl.

CPC ..... *F41C 23/16* (2013.01); *F41C 23/12* (2013.01); *F41C 23/14* (2013.01); *F41C 23/22* (2013.01)

(58) Field of Classification Search

CPC ..... F41C 23/16
USPC ..... 42/72
See application file for complete search history.

(56) References Cited

U.S. PATENT DOCUMENTS

| | | | | |
|---|---|---|---|---|
| 8,245,428 | B2 * | 8/2012 | Griffin | F41C 23/16 42/72 |
| 2005/0188588 | A1 * | 9/2005 | Keng | F41C 23/16 42/72 |
| 2006/0064913 | A1 * | 3/2006 | Gablowski | F41C 23/16 42/72 |
| 2009/0056192 | A1 * | 3/2009 | Oz | F41C 23/16 42/94 |
| 2011/0179688 | A1 * | 7/2011 | Ash, Jr. | F41C 23/16 42/72 |

* cited by examiner

*Primary Examiner* — Stephen Johnson

(57) ABSTRACT

The vertical forward grip is a revolutionary new design, which increases shooter(s) accuracy, providing comfort to the shooter and increasing control of the weapon, while reducing fatigue to the shooter(s) overall stamina. The overall design, ergonomic feel, textured finger grip and an ergonomic index finger stabilization cradle of the vertical forward grip allows the shooter(s) to remain comfortable for long extended periods of time, increasing accuracy and control, providing stabilization of the weapon and the design features are different from conventional vertical forward grip(s). Specific design features/improvements are incorporated into the vertical forward grip unlike the design of conventional vertical forward grip(s). Design features and improvements include: a ergonomic index finger stabilization cradle, a textured finger grip, an ergonomic grip control feature (increasing grip comfort, control and accuracy), and a threaded quick turn-and-release base grip cap tube (⅞"-9 UNC Double 2A Thread).

10 Claims, 3 Drawing Sheets

VERTICAL FORWARD GRIP

CROSS REFERENCE TO RELATED APPLICATIONS

This application is a continuation-in-part of U.S. patent application Ser. No. 14/545,901, filed on Jul. 6, 2015, (now abandoned) and claims the benefit of this priority. This application also claims priority from U.S. provisional patent application No. 62/119,502, filed on Feb. 23, 2015.

(Vertical Forward Grip) Field of classification search (42/72; 42/94), International classification (F41A 35/06; F41C 23/12; F41C 23/14; F41C 23/22; F41C 27/00), U.S. classification CPC (42/94; 42/73; F41C 27/00; F41C 27/22; F41C 23/22) and U.S. classification USPC (42/72; 362/110).

STATEMENT REGARDING FEDERALLY SPONSORED RESEARCH OR DEVELOPMENT

Not Applicable.

NAMES OF THE PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

Not Applicable.

REFERENCE TO A "SEQUENCE LISTING," A TABLE, OR A COMPUTER PROGRAM LISTING APPENDIX SUBMITTED ON A COMPACT DISC AND AN INCORPORATION BY REFERENCE OF THE MATERIAL ON THE COMPACT DISC. THE TOTAL NUMBER OF COMPACT DISC INCLUDING DUPLICATES AND THE FILES ON EACH COMPACT DISC SHALL BE SPECIFIED

Not Applicable.

BACKGROUND OF THE INVENTION

A vertical forward grip may consist of a device attached to a Picatinny, Weaver or similar mounting rail integration system of a short barreled rifle, long barreled rifle, shotgun or related type of firearm. The upper portion of the vertical forward grip may be quickly detached or locked into permanent position via locking mechanism. The vertical forward grip includes an internal storage space for multiple types of batteries and miscellaneous item(s). The vertical forward grip can be adjusted on the rail of the firearm platform to assist with the operator(s) necessities. The vertical forward grip is comprised of an ergonomic configuration suited to the purposes of the operator(s) natural grip and control.

Conventional vertical forward grip(s) provide a less desired grip, creating fatigue on the shooter(s), reducing the shooter(s) accuracy. Conventional vertical forward grips do not stabilize the firearm as well, providing moderate comfort and control. Conventional vertical forward grips do not give the desired control and comfort to the shooter, fatiguing the shooter over long extended periods of use.

Presently there is no solution with a conventional vertical forward grip(s) to increase stability, accuracy, control and comfort of a firearm.

Therefore, it is the design of this current invention that provides a new and improved vertical forward grip for mounting on firearms.

It is another design improvement of this current invention to provide a new and improved vertical forward grip with the implementation of the ergonomic forward finger stabilization cradle.

It is another design improvement of this current invention to provide a new and improved vertical forward grip with the implementation of the improved textured grip placement.

It is another design improvement of this current invention to provide a new and improved vertical forward grip with the implementation of the improved integrated threaded quick turn-and-release base grip cap tube, via quick mounting and removal of the vertical forward grip.

It is another design improvement of this current invention to provide a new and improved vertical forward grip with the implementation of the improved integrated threaded quick turn-and-release base grip cap tube, via adjustment of the vertical forward grip along the longitudinal axis of the of the rail integration system.

It is another design improvement of this current invention to provide a new and improved vertical forward grip with the implementation of the quick turn-and-release, removal of stored miscellaneous item(s) inside of the threaded quick turn-and-release base grip cap tube.

BRIEF SUMMARY OF THE INVENTION

In brief, to attain the preferred design improvement of the invention in accordance with the preferred embodiment thereof, a vertical forward grip is disclosed. The present invention seeks to provide a solution to this problem by providing a more ergonomic feel to the shooter while giving additional stability to the weapon improving accuracy/control/comfort to the shooter, with the implementation of the improved texture grip placement and ergonomic index finger stabilization cradle.

BRIEF DESCRIPTION OF THE SEVERAL VIEWS OF THE DRAWING

The following changes and specific design improvements of this current invention will become starkly apparent from the following detailed description of the invention, when taken into consideration with the drawings, in which.

DETAILED DESCRIPTION OF THE INVENTION

Figure 1:
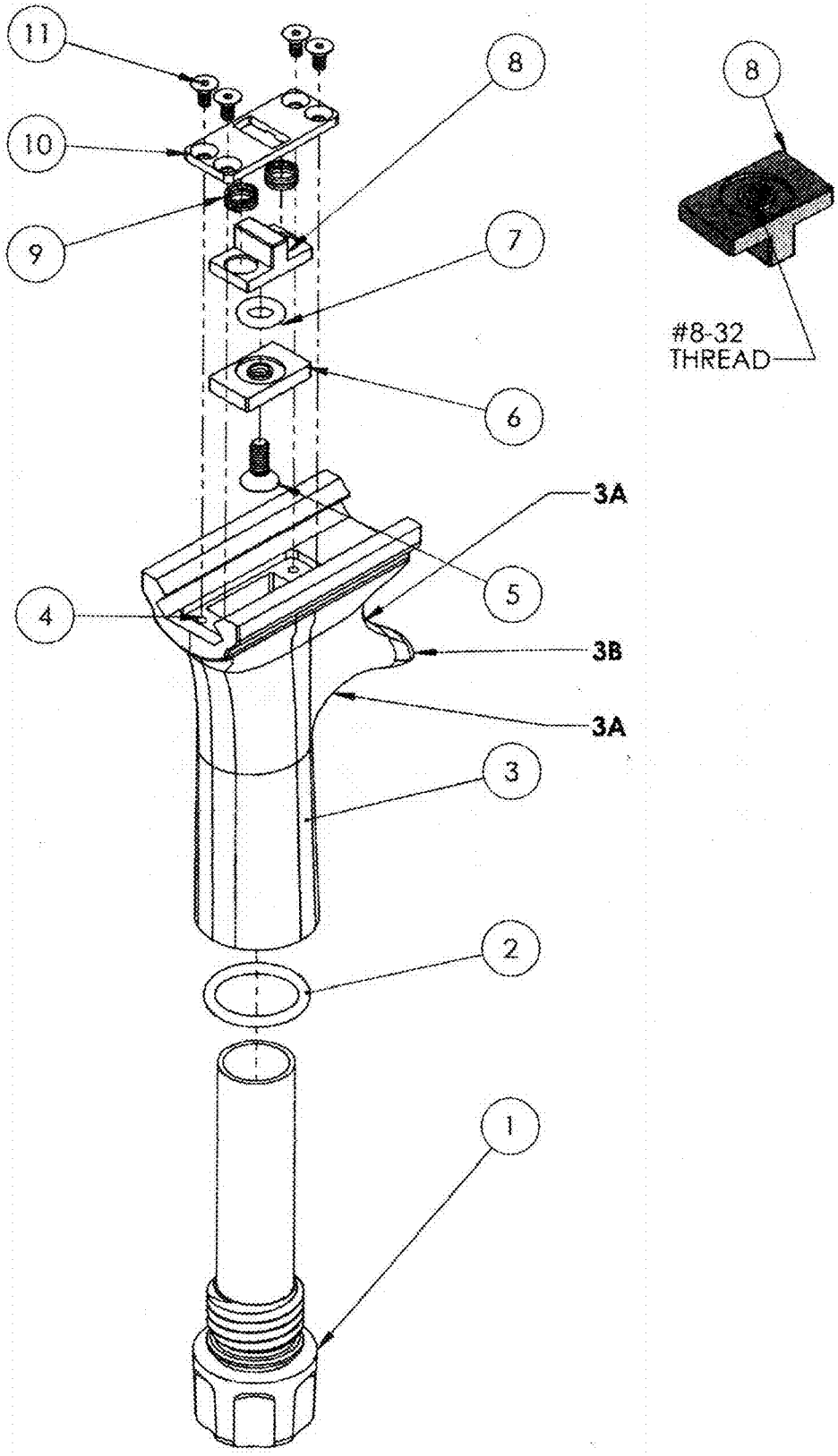
FIG. 1 is an exploded sectional view of the vertical forward grip of FIG. 2, FIG. 3 FIG. 4, FIG. 5 & FIG. 6.
Figure 2:
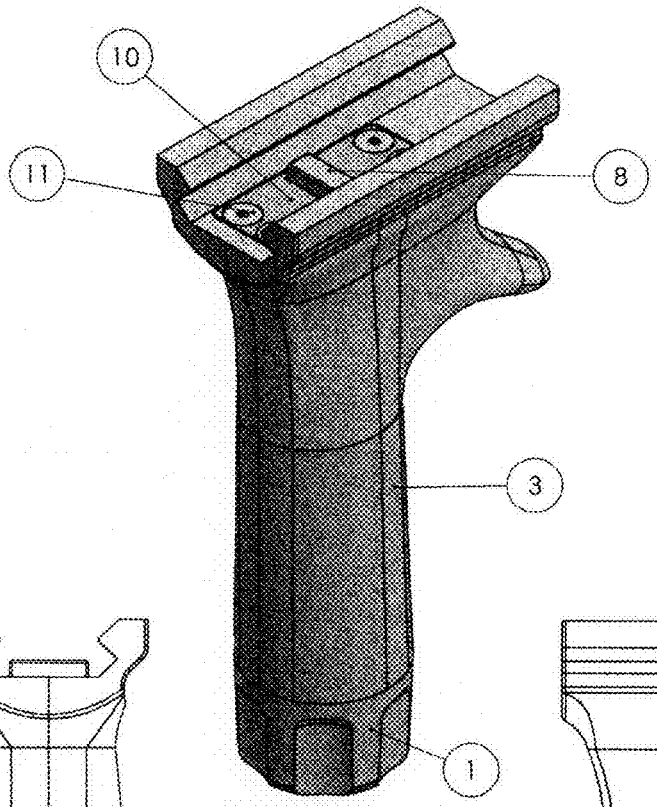
FIG. 2 is a perspective view of the vertical forward grip, in accordance with the present invention.
Figure 3:
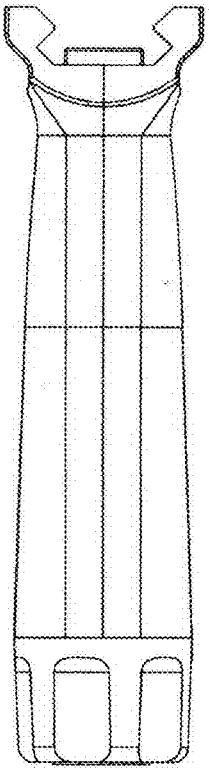
FIG. 3 is a rear view of the vertical forward grip.
Figure 4:
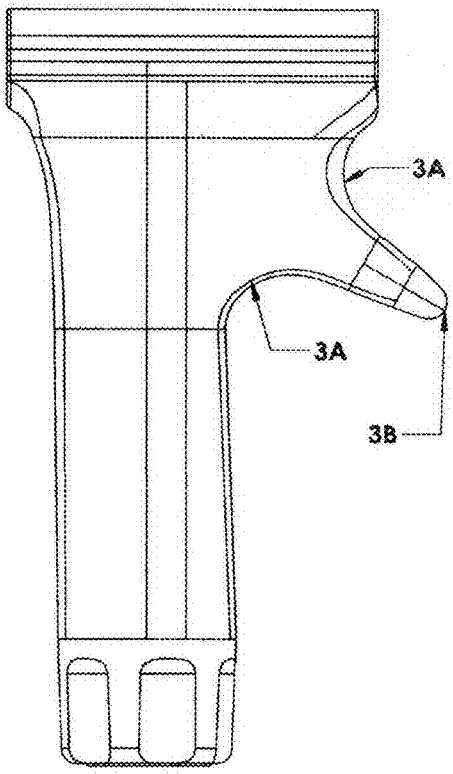
FIG. 4 is a side view of the vertical forward grip.

Turning to FIG. 1, a vertical forward grip in accordance with the current invention, is illustrated. Vertical forward grip 3 includes an improved textured finger grip placement 3A and ergonomic index finger stabilization cradle 3B. Integrated with the vertical forward grip 3 includes a lower sealing threaded quick turn-and-release base grip cap tube 1, allowing for storage, quick removal and adjustment/positioning on the lower portion of the rail integration system. In combination with the threaded quick turn-and-release base grip cap tube 1 and a base grip tube O-ring 2 is positioned between a threaded quick turn-and-release base grip cap tube 1 and a vertical forward grip 3, to provide a moisture tight seal. Illustrated in FIGS. 2, 4 and 6, the ergonomic configuration is suited to the purposes of the operator(s) natural grip and control per textured finger grip 3A and an ergonomic index finger stabilization cradle 3B.

Referring additionally to FIG. 1, a vertical forward grip in accordance with the current invention, is illustrated. Vertical forward grip 3 includes an aperture for attaching a lower rectangular base mount screw (8-32×7/16") 5 in conjunction with a lower rectangular base plate 6 fastening the lower base plats O-ring 7 within the circular recessed portion of a lower rectangular base plate 6. Consequently, the lower rectangular base mount screw (8-32×7/16") 5, is fastened to an aperture located at the base of the rectangular bar-shaped mounting clamp 8, securing the lower rectangular base plate 6 and the lower base plate O-ring 7 to the rectangular bar-shaped mounting clamp 8. Ultimately, the lower base plate O-ring 7 absorbs pressure between lower rectangular base plate 6 and the rectangular bar-shaped mounting clamp 8.

Referring additionally to FIG. 1, a vertical forward grip in accordance with the current invention, is illustrated. Vertical forward grip 3 includes four base plate retention screws (4-40×¼") 11 fastened to four base plate retention screw apertures 4 on the upper section of the vertical forward grip 3 securing the upper rectangular spring retention base plate 10 to the upper section of the vertical forward grip 3. The upper rectangular spring retention base plate 10 is fastened to the upper section of the vertical forward grip 3 in combination with four base plate retention screws (4-40×¼") 11 securing the base plate retention screw apertures 4 to the upper rectangular spring retention base plate 10. The upper rectangular spring retention base plate 10 encloses two retaining springs 9, a rectangular bar-shaped mounting clamp 8, a lower base plate O-ring 7, a lower rectangular base plate 6 and a lower rectangular base mount screw 5 secured inside of the upper section of the vertical forward grip 3.

Referring additionally to FIG. 1, a vertical forward grip in accordance with the current invention, is illustrated. Vertical forward grip 3 includes a threaded quick turn-and-release base grip cap tube 1. This threaded turning advances threaded quick turn-and-release base grip cap tube 1 inside of the vertical forward grip 3 in the direction toward the lower rectangular base plate 6. Ultimately, the top end of the threaded quick turn-and-release base grip cap tube 1 abuts the lower rectangular base plate 6 and pushes the lower rectangular base plate 6 upward (as seen in FIG. 1). The rectangular bar-shaped mounting clamp 8 is attached to the lower rectangular base plate 6 via lower rectangular base mount screw 5 that screws into the bottom threaded aperture of the rectangular bar-shaped mounting clamp 8. Consequently, when the lower rectangular base plate 6 is pushed upwardly, the attached rectangular bar-shaped mounting clamp 8 is also pushed upwardly. Such upward biasing forces the rectangular bar-shaped mounting clamp 8 into the opening of the upper rectangular spring retention base plate 10. This forward biasing forces the retaining springs 9 to contract. Ultimately, this upward biased extension of the rectangular bar-shaped mounting clamp 8 extends into the opening of the rail integration system 12 to lock the entire assembly with regard to the rail integration system 12 (see FIG. 6). When the threaded quick turn-and-release base grip cap tube 1 is rotated in the opposite direction, biased extension of the rectangular bar-shaped mounting clamp 8 moves downwardly permitting the retention springs 9 to push the rectangular bar-shaped mounting clamp 8 in its lower most position. The rotation of the threaded quick turn-and-release base grip cap tube 1 provides adjustable pressure between the retaining springs 9, a rectangular bar-shaped mounting clamp 8, a lower base plate O-ring 7, a lower rectangular base plate 6 and a lower rectangular base mount screw 5 providing adjustability or removal of the vertical forward grip 3 along the axis of the rail integration system 12.

Figure 5:
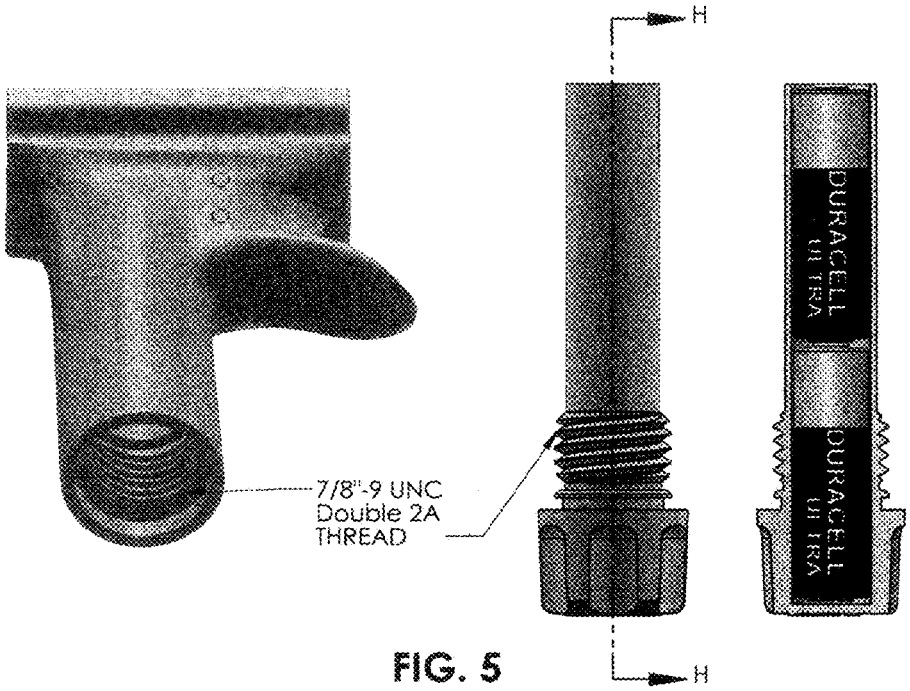
FIG. 5 is a horizontal view of the vertical forward grip and side view of the base grip cap tube.

In reference to FIG. 5, a vertical forward grip in accordance with the current invention, is illustrated. The vertical forward grip in FIG. 5 is a representation of the vertical forward grip 3 positioned on a horizontal axis to reveal the internal thread pattern (as seen in H, ⅞"-9 UNC Double 2A Thread) located on the inside of the vertical forward grip 3. Further the threaded quick turn-and-release base grip cap tub 1, in FIG. 5 is positioned vertically to reveal the external thread pattern (as seen in H, ⅞"-9 UNC Double 2A Thread) and provide an internal storage capacity representation of the threaded quick turn-and-release base grip cap tube 1. Further referencing FIG. 5, is a representation of the ⅞"-9 UNC Double 2A Thread allowing for quick removal, positioning, adjustment and attachment of the threaded quick turn-and-release base grip cap tube 1 and the vertical forward grip 3 (as seen in FIG. 1) on the lower portion of the rail integration system 12 (see FIG. 6).

Figure 6:
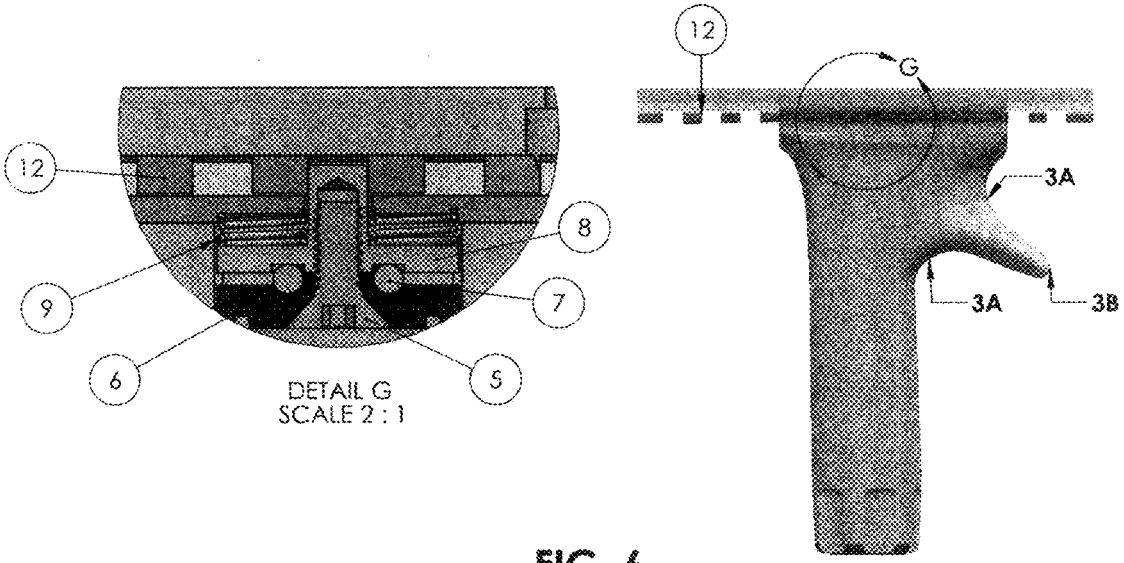
FIG. 6 is a side view of the vertical forward grip and picatinny rail.

In reference to FIG. 6, a vertical forward grip in accordance with the current invention, is illustrated. The vertical forward grip in FIG. 6 is a side view representation of the vertical forward grip 3 and the threaded quick turn-and-release base grip cap tube 1 (as seen in G), integrated with a rail integration system 12, secured and locked into position on the rail integration system 12. Further represented in detail G is an exploded view of the enclosed internal components within the vertical forward grip 3 (i.e. FIG. 1, upper rectangular spring base plate 10, retaining springs 9, rectangular bar-shaped mounting clamp 8, lower base plate O-ring 7, lower rectangular base plate 6 and the lower rectangular base mount screw 5).

In the assembly and operation or positioning of the vertical forward grip 3 and its components 1-11, Illustrated in FIG. 1-6, components 1 and 3 interlock with components 4-11, securing the upper portion of 3 to the rail integration system 12 via removability, positioning, attachment and adjustment along the recessed slots of the lower rail integration system 12. Thus the vertical forward grip 3 has a stable platform when secured into place by rotating the quick turn-and-release integrated base grip cap tube 1, which in turn engages the rectangular bar-shaped mounting clamp 8 into the recessed slots of the lower portion of the rail integration system 12. The vertical forward grips components 1-11 can be quickly adjusted on the rail integration system 12 of the firearm platform to assist with the operator(s) necessities. The vertical forward grip 3 is comprised of a textured finger grip 3A and an ergonomic index finger stabilization cradle 3B providing optimal grip placement in regard to the operator(s) natural grip, comfort and control, reducing fatigue on the operator and increasing the shooters accuracy and stabilization of the weapon.

Therefore, a new and improved vertical forward grip design is shown and described. The new and improved vertical forward grip is designed to provide a solution to this problem by providing a more ergonomic feel to the shooter while giving additional stability of a firearm and accuracy/ control/comfort to the shooter, with the implementation of the improved textured finger grip and ergonomic index finger stabilization cradle.

This vertical forward grip is a revolutionary new design, which increases shooter(s) accuracy, providing comfort to the shooter and increasing control of the weapon, while reducing fatigue to the shooter(s) overall stamina. The overall design, ergonomic feel, textured finger grip placement and the ergonomic index finger stabilization cradle of the vertical forward grip allows the shooter(s) to remain comfortable for long periods, increasing accuracy and control, and new design features are different from conventional vertical forward grip(s). Specific design features/improvements are incorporated into the vertical forward grip unlike the design of conventional vertical forward grip(s). Design features and improvements include: a ergonomic index finger stabilization cradle, a textured finger grip, a ergonomic grip control feature (increased grip control and accuracy) and a threaded quick turn-and-release base grip cap tube (⅞"-9 UNC Double 2A Thread).

Various changes, improvements and modifications to the vertical forward grip, will be clearly recognized in the illustrations. Such modifications and specific design improvements of this current invention, along with a detailed description, are intended and included within the scope which is assessed only by a fair interpretation of the following claims.

Having fully described the improvements, along with a detailed description, in a clear and concise manner, to help assist with the understanding of the invention claimed.

The invention claimed is:

1. A firearm forward grip mounting device comprising:

a) a vertical forward grip assembly with an internal threads located inside and at a lower portion of the forward grip assembly, a dovetail mortise with an associated rail receiving cavity located at an upper portion of the forward grip assembly;

b) a grip cap tube with associated cap and with external threads located adjacent said associated cap; the internal threads gripping the external threads when the grip cap tube and the forward grip assembly as screwed together;

c) a spring retention base plate located inside of the rail receiving cavity and said retention base plate attached to the vertical forward grip assembly;

d) a mounting clamp that includes a bar attached at a mounting clamp upper side and a rectangular base plate attachable to the mounting clamp; and e) the spring retention base plate including a central opening receiving the bar wherein the bar extends above the central opening when the mounting device is in an engaged position, and the central opening receiving the bar but the bar not extending above the central opening when the mounting device is in a disengaged position; and f) a spring element that acts to bias the mounting clamp with associated said bar into the disengaged position.

2. A firearm forward grip mounting device as claimed in claim 1, further comprising an O-ring located between the vertical forward grip assembly and the grip cap tube.

3. A firearm forward grip mounting device as claimed in claim 2, further comprising a second O-ring located between the mounting clamp and the rectangular base plate.

4. A firearm forward grip mounting device as claimed in claim 1, wherein the spring element is retaining springs located between the spring retention base plate and the mounting clamp.

5. A firearm forward grip mounting device as claimed in claim 4, wherein the internal threads and external threads are designed to provide quick turn-and-release for attaching and detaching the vertical forward grip assembly to the grip cap tube; and wherein the retaining springs are two springs located on opposite sides of the central opening.

6. A firearm forward grip mounting device as claimed in claim 1, further comprising four base plate retention screws to provide the attachment to the vertical forward grip assembly.

7. A firearm forward grip mounting device as claimed in claim 6, further comprising an index finger cradle feature located on the vertical forward grip assembly to assist in stabilization of a firearm.

8. A firearm forward grip mounting device as claimed in claim 1, further a base mount screw for attaching said retention base plate to the vertical forward grip assembly.

9. A firearm forward grip mounting device as claimed in claim 1, further comprising an index finger cradle feature located on the vertical forward grip assembly to assist in stabilization of a firearm.

10. A firearm forward grip mounting device as claimed in claim 9, wherein the grip cap tube has an interior cavity to provide storage for batteries.

* * * * *